US006379409B1

(12) United States Patent
Dijkman

(10) Patent No.: US 6,379,409 B1
(45) Date of Patent: Apr. 30, 2002

(54) DUST BAG

(75) Inventor: Bertus Dijkman, Breda (NL)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/578,299

(22) Filed: May 25, 2000

(51) Int. Cl.[7] ..... A47L 9/14

(52) U.S. Cl. ..... 55/381; 55/382; 55/DIG. 2; 156/510; 156/513; 156/514

(58) Field of Search ..... 55/381, 382, DIG. 2, 55/367, 369; 156/510, 513, 514, 530, 515

(56) References Cited

U.S. PATENT DOCUMENTS

| | | | | | |
|---|---|---|---|---|---|
| 1,995,830 | A | * | 3/1935 | Barnsby | 55/DIG. 2 |
| 3,392,906 | A | * | 7/1968 | Fesco | 55/DIG. 2 |
| 3,404,515 | A | * | 10/1968 | Fesco | 55/DIG. 2 |
| 3,751,881 | A | | 8/1973 | Hughes | |
| 4,237,524 | A | | 12/1980 | Hundemer | |
| 4,539,027 | A | * | 9/1985 | Fornas et al | 55/DIG. 2 |
| 5,468,330 | A | * | 11/1995 | Ryan et al. | 55/DIG. 2 |
| 6,224,645 | B1 | * | 5/2001 | Ryan et al. | 55/DIG. 2 |

FOREIGN PATENT DOCUMENTS

| | | |
|---|---|---|
| DE | 2 310 160 | 9/1974 |
| DE | 2 416 079 | 10/1975 |
| DE | 28 06 305 | 9/1982 |
| EP | 0 179 950 | 5/1986 |
| EP | 0 813 839 | 12/1997 |
| GB | 954996 | 4/1964 |
| GB | 1433991 | 4/1976 |
| JP | 8-38402 | 2/1996 |
| JP | 8-38403 | 2/1996 |

OTHER PUBLICATIONS

Swirl™, Staubsauger–Beutel, Typen–Katalog, May 1994.

* cited by examiner

*Primary Examiner*—Duane Smith
*Assistant Examiner*—Minh-Chau T. Pham
(74) *Attorney, Agent, or Firm*—Gary L. Griswold; Robert W. Sprague; William J. Bond

(57) ABSTRACT

The invention relates to a dust bag to be used primarily in vacuum cleaners, the dust bag having at least two opposing wall portions of filter material in an overlaying state and an intake opening for receiving a socket piece of a vacuum cleaner. The two opposing wall portions are connected to each other at one edge forming an outer edge of the dust bag. The wall portions each have recess open to the outer edge. The recesses (36*a*, 36*b*) are identical in their shape and size and opposed to each other in the overlaying state. The two recesses of the wall portions form the intake opening. Additionally, the intake opening can be surrounded by a mounting means for mounting the dust bag at a socket piece from which dust-like material is discharged. The mounting means includes at least two mounting elements each fixed to one of the two wall portions.

12 Claims, 3 Drawing Sheets

DUST BAG

The invention relates to dust bags to be used primarily in vacuum cleaners. More particularly, the invention refers to dust bags provided with an intake opening for receiving a socket piece of a vacuum cleaner or the like. Further, the invention relates to methods of producing such dust bags.

Collection equipment for dust and similar materials, such as vacuum cleaners, requires the use of containers or bags for the material to be collected. These bags can consist of paper or any other filtration type material which on the one hand allows to collect the dust and dust-like material and on the other hand has a porosity sufficient for the fluid carrying the dust or dust-like material to penetrate through the walls of the filter-like material with a minimum pressure drop. The materials are well known to the artisan in the field.

Typically these dust bags are provided with a single intake opening through which the dust or dust-like material is to be transported and collected within the bag. For a number of reasons, this opening should preferably be reinforced by a suitable means. Most typically this is achieved through the use of a mounting means for mounting the dust bag at the socket piece. Such mounting means or so-called collars have an opening most typically of a circular form which practically corresponds to the opening within the bag. The collar is attached to the bag so that a sealing effect is obtained which prevents the fluid and the dust to pass through openings other than the openings of the dust bag and the collar. The collar consists of a relatively stable material, such as cardboard or plastic.

EP 0 179 950 describes a dust bag and especially methods for attaching a mounting means in a sealing manner by applying adhesive around the opening within the filter bag. The mounting means is designed to receive a socket piece from which dust is discharged and which can be passed through its opening so that the mounting means is slightly stretched and will be fastened in sealing abutment around the socket piece.

DE 28 06 305 describes a vacuum cleaner bag having a collar, and methods for manufacturing said bag. Also here a collar is sealingly attached to the bag through the use of an adhesive.

DE 24 16 079 describes a similar configuration in which dust bags are used that are folded in a special manner and are provided with an opening onto which the collar is attached, again through the use of an adhesive.

DE 23 10 160 relates to a method in which a hose consisting of the above described filter material is produced in a continuous process wherein pieces of this hose are cut off and their ends are folded and sealed in order to form a completely closed bag. On one side of this bag, an opening for sealing attachment of a collar therein is formed in one layer.

JP 8-38402 and JP 8-38403 relate to a so-called three-dimensional bag which has folded wall portions as e.g. illustrated in FIG. 3 of JP 8-38402 which can be obtained from a four-sided bag with open ends wherein two opposing wall portions are folded inwardly. In one of the two others unfolded wall portions an opening is provided onto which a collar can be attached. The two ends are then closed and sealed. The dust bag is folded along a center line extending perpendicularly to the sealed ends through the collar and the opening therein and is formed in one of the wall portions. The collar may extend beyond one of the sealed ends.

In all of the known filter bag designs the opening is provided in one of the wall portions of the hose of the filter material established by the wall portions. This provision of the opening is rather complicated to manufacture. Filter bags of the described type are typically disposable items. Therefore, it is essential to minimize both the material consumption and the overall manufacturing cost.

It is an object of the invention to provide a dust bag and methods to produce dust bags in a simple manner requiring only few manufacturing steps. This object is solved by a dust bag according to claim 1 and by methods for manufacturing dust bags according to claims 11 and 14.

According to the invention a dust bag for collecting dust-like material, particularly for vacuum cleaners, with at least two opposing wall portions of filter material and with an intake opening is provided, wherein the two wall portions are connected to each other and define an outer edge of the dust bag; the wall portions each have a recess which is open to the outer edge; the recesses of the wall portions are identical in shape and size and opposed to each other in the overlaying state of the wall portions, and the two recesses of the wall portions form the intake opening.

According to the invention, the dust bag comprises at least two wall portions of filter material which in an overlaying state are opposed to each other. The two opposing wall portions are connected to each other at one outer edge of the dust bag. Each wall portion has a recess that is open to the aforementioned edge. The two recesses are identical in shape and size and opposed to each other in the overlaying state. When using the dust bag, the dust bag is unfolded from its overlaying state into an unfolded state. In this state, the two recesses form the intake opening for receiving the socket piece. The remaining edges of the dust bag are also connected to each other. The edges are obtained by connecting two adjacent wall portions and/or by folding the wall portions.

The wall portions of the dust bag according to the invention can be made from a filtering material selected from the group comprising paper, synthetic material, non-woven material, in particular of recyclable polypropylene, as known to someone skilled in the art.

Since the recesses are opposed to each other in the overlaying state, they can be cut into the wall portions within one manufacturing step. Each recess forms a half of the intake opening.

Preferably, the intake opening of the dust bag is surrounded by a mounting means for mounting the dust bag to the socket piece. By insertion of the socket piece into and through the intake opening of the dust bag, the mounting means due to its dimensions can be frictionally seated, thus fixing the dust bag sealingly to the socket piece. According to the invention, the mounting means comprises at least two mounting elements. Each element is fixed to one of the two opposing wall portions and arranged adjacent to the common edge of the two wall portions. Thus, the mounting elements are opposed to each other in -the overlaying state. In the unfolded state of the dust bag, the mounting elements are arranged in one plane and form the so-called collar. A sealing element may be arranged e.g. by adherence at the inner edge of the collar for sealing the mounting element to the socket piece.

In a preferred embodiment of the dust bag, the two mounting elements are flexibly connected to each other. The two mounting elements are connected e.g. via a thin foil. Preferably, the two mounting elements are connected via a spacer element. The spacer element has a width corresponding to the thickness of the wall portions being arranged between the mounting elements in the overlaying state. Thus, the dust bag is relatively flat in the overlaying state and can be stored easily. The spacer element is flexibly connected to each of the two mounting elements.

The mounting means can be made of one piece. To provide a mounting means having two flexibly connected mounting elements, the one-pieced mounting means can be cut along a symmetry axis wherein the depth of the cut is less than the thickness of the mounting means. Another possibility to manufacture a mounting means out of one piece having two flexibly connected mounting elements is to perforate the mounting means along the symmetry axis. This symmetry axis is in alignment with the common edge of the two wall portions. In both cases described above the one-piece mounting means is provided with a line of weakness and/or a living hinge to facilitate flexibility of the integral connection of the two mounting elements.

If the two mounting elements are connected via a spacer element, the flexible connection between the mounting elements and the spacer element can also be achieved by the aforementioned cutting process or by perforating, i.e. by providing lines of weakness between each of the mounting elements and the spacer element, respectively.

In addition, it is possible to fold the wall portions in a manner providing a three-dimensional dust bag. Furthermore, additional wall portions can be used and connected with the two opposing wall portions to manufacture a three-dimensional dust bag. Each wall portion may comprise one or several layers of gas permeable (filter) material.

A preferred method for manufacturing dust bags according to the invention comprises the steps of overlaying two wall portions of a filter material such that said wall portions are connected along an outer edge of the bag, and cutting recesses into both wall portions within one step, which recesses are open to said outer edge and together form an intake opening.

If desired, after the cutting step, the recesses can be surrounded by a mounting means at opposite sides of the wall portions facing away from each other. For this purpose, mounting means as described above can be used, in particular a mounting means comprising two mounting elements each fixed to one wall portion adjacent to the edges and opposed to each other in the overlaying state of the wall portions. The mounting means having an opening to receive the socket piece can also be fixed to the wall portions before the cutting step is performed.

Another preferred method for manufacturing a dust bag according to the invention combines the manufacture of the recesses in the mounting means and the cutting of the recesses into both wall portions. Thus, after the step of overlaying two wall portions of filter material as described above, a mounting element is fixed to each of said wall portions at the outer side of each wall portion such that both mounting elements are opposed to each other and arranged adjacent to the outer edge of the wall portions. After this step, recesses are cut into both wall portions and both mounting elements in one step. The recesses are open to the outer edge of the wall portions and form the intake opening. Preferably, the mounting elements are already flexibly connected.

Within the first step of the two above-described methods it is possible to supply two sheets of filter material separately to form two opposing wall portions. After this supplying step, the outer edges extending in the supply direction can be connected to each other to form a continuous hose or tube of filter material. Thereafter, the recesses are cut into both of the wall portions or into both of the wall portions and the mounting elements. It is also possible to connect the edges extending in the supply direction, after the cutting of the recesses. Thereafter, the hose having recesses and, if desired, provided with mounting means if desired, is cut into preferably regular intervals. The thus created two additional open sides are connected such that a bag is obtained which has an essentially rectangular shape with all four sides sealed together.

Since a hose or tube is easier to handle, the two opposing wall portions are connected to each other along connecting lines which are vertical to the feeding direction before they are cut into dust bags between these two connecting lines. Thus, a bag with all four sides sealed together is obtained directly after the final cutting step.

Instead of feeding two sheets of filter material separately to form the two opposing wall portions, it is also possible to feed only one sheet of filter material which is folded to form the two opposing wall portions. The folding line extends in the feeding direction. Thereafter, the dust bag is manufactured by one of the above-described various methods.

In any of the described methods according to the invention, it is also possible to form a three-dimensional bag by folding the wall portions as desired or by adding additional wall portions.

IN THE DRAWINGS

Hereinafter are described preferred embodiments of the dust bag and preferred manufacturing methods of the dust bag according to the invention FIG. 1 is a schematical perspective view of a preferred manufacturing method.

DETAILED DESCRIPTION OF THE PREFERRED EMBODIMENT

Figure 1:
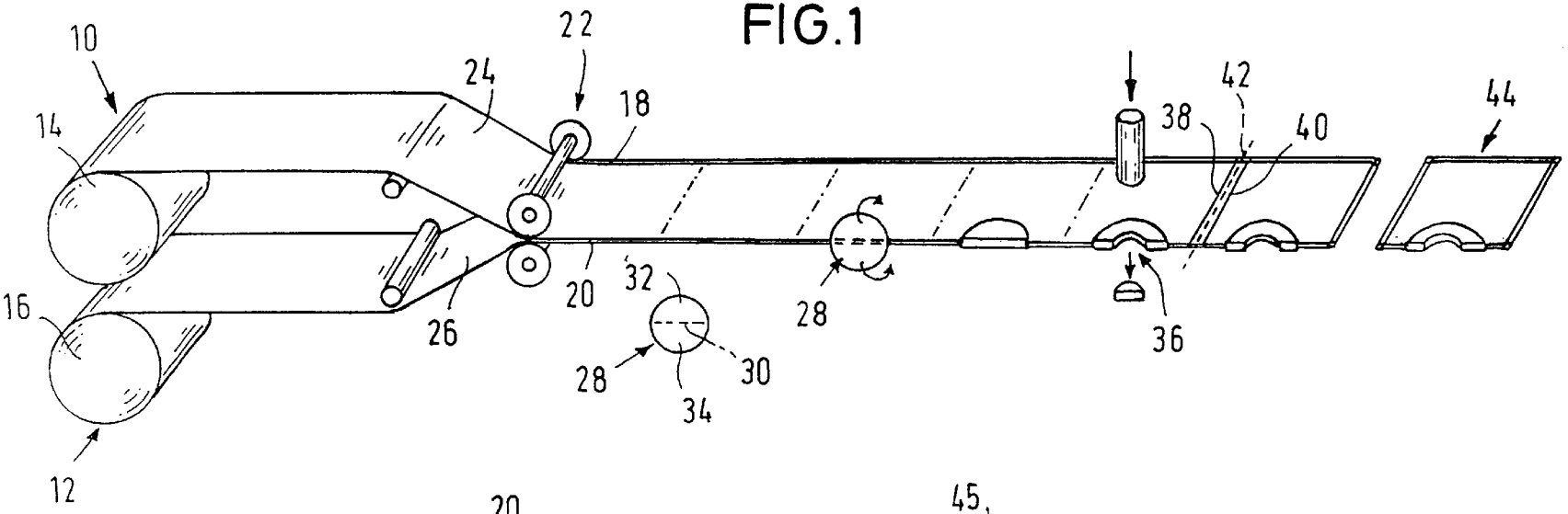

FIG. 1 shows a preferred manufacturing process according to the invention. In a continuous process two sheets 10,12 of a single layer or multiple layer filter material of a given width are unrolled from two rolls 14,16. These two sheets 10,12 are then brought together and joined at the two longitudinal outer edges 18,20 through a heat-sealing or ultrasonic welding process by means of a connecting device 22.

Accordingly, a flat hose is provided, essentially consisting of two wall portions 24,26 of filter material, an upper wall portion 24 and a lower wall portion 26, which are sealingly joined together at their longitudinal sides. A mounting means 28 or so-called collar of a relatively stable material, either consisting of a piece of cardboard or a plastic material such as polyethylene or polypropylene may be provided with a layer of adhesive which preferably is laminated onto it or over the entire surface of the collar 28. The collar 28 is provided with at least one line of weakness (perforation or cutting line) so that it can be folded. A first mounting element 32, i.e. the first half of the collar 28 is adhered to the upper wall portion 24 along the edge 20 of the bag. A second mounting element 34, i.e. the second half of the collar 28 is folded until it can be adhered to the lower wall portion 26 of the dust bag.

Figure 3:
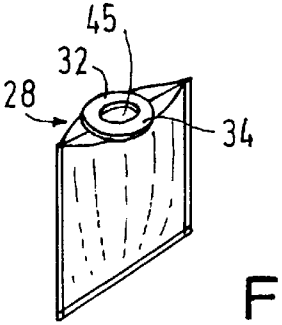
FIG. 3 is a schematical perspective view of the dust bag shown in FIG. 2 in its unfolded state.
Figure 2:
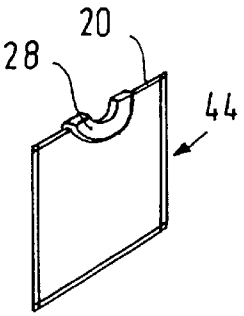
FIG. 2 is a schematical perspective view of a preferred embodiment of the dust bag in its overlaying state.

The collar 28 as well as the underlying wall portions 24,26 of filter material of the bag are then provided with recesses 36 which are semi-circular cuts in the shown manufacturing process. Within the next method step, the two filter wall portions 24,26 are perpendicular to each other along connecting lines 38,40 which are vertical-to the supply direction. Thus, all four edges of the dust bag are connected to each other. Then, in regular intervals of the desired length of the dust bag, the two opposing wall portions 24,26 are cut along a cutting line 42 to obtain dust bags 44 as shown in FIG. 2. The dust bag with collar 28 is now ready for use. The two mounting elements 32,34 of the mounting means 28 can be unfolded until they are brought into an essentially flat form (FIG. 3) wherein the recesses of the mounting elements 32,34 form the intake opening 45. The dust bag then automatically unfolds itself and forms a complete bag as shown in FIG. 3. If the dust bag 44 is used, it stays open in its unfolded state.

The continuous hose or tube can be separated into pieces with a straight cut, and further with a cutting tool that provides a rounded edge on the sides. Accordingly some material of the filter has to be discarded. Similarly such cut can also be provided at the longitudinal edges 18,20. In this case, however, it has to be ensured that the sealing or welding process is performed after the cutting. By these or similar methods a whole variety of configurations can be obtained, such as e.g. a trapezoidal or even an elliptical or round bag. However, there may be configurations where it is still more advantageous to produce a bag in this manner.

Figure 4:
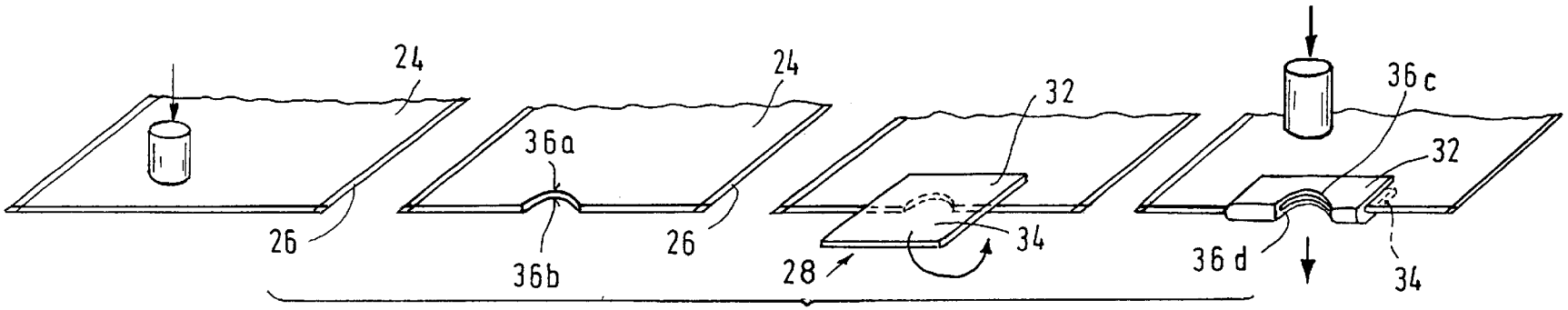
FIG. 4 illustrates the steps of another preferred manufacturing process.

The collar 28 itself can have any shape according to the requirements for the intended use. For example, it can be essentially rectangular, round or elliptical. FIG. 4 shows another preferred manufacturing method for manufacturing a dust bag according to the invention. Herein the two recesses 36*a* and 36*b* which are cut in the two opposing wall portions 24,26 are cut in these wall portions 24,26 before a mounting means 28 is fixed on the two wall portions 24,26. In the next step, the mounting means 28 is fixed on the two opposing wall portions 24,26. Within the next step, recesses 36*c* and 36*d* are cut into both mounting elements 32,34 of the mounting means 28. The obtained dust bag 44 is identical with the dust bag manufactured according to the process described in FIG. 1.

Figure 5:
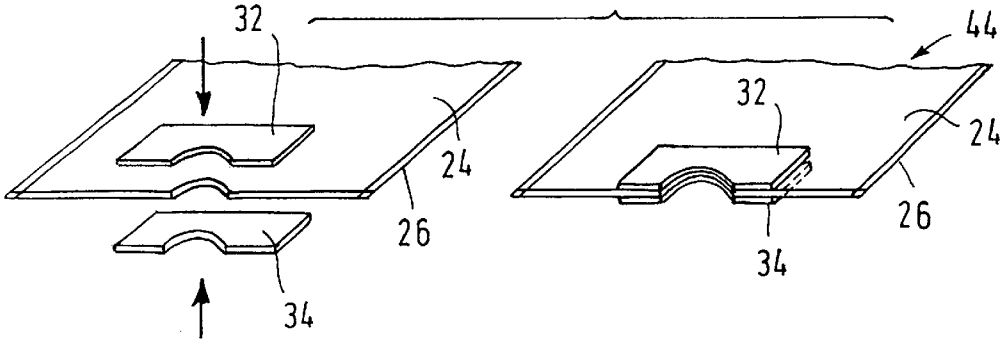
FIG. 5 illustrates the steps of an additional preferred manufacturing process.

The basic feature of the collar 28 is that for its intended use it must be brought into an essentially flat configuration and it has to be given inherent stability to be intrinsically stable. This, however,—can also be achieved by using separated mounting elements 32,34 which are applied to the two wall portions 24,26 of the dust bag completely independently as depicted in FIG. 5. The two mounting elements 32,34 are then connected through the filter material as such, which in certain applications may be sufficient. However, it may be advisable to adhere an additional layer of flexible or elastic material between the mounting elements 32,34 of the collar 28 and the bag 44.

It is essential that the collar 28 is adhered to the bag in a sealing manner. However, it is not necessary to apply adhesive over the entire surface. For example, adhesive may be applied only in an inner circle while the outer portion is free of adhesive. This may be advantageous when it is necessary to insert the collar into a holding means of the vacuum cleaner. Alternatively, strips of adhesive material are applied onto the upper and lower side of the dust bag, the strip for example being a piece of a so-called transfer tape. Transfer tape on a liner is applied onto the-bag whereupon the liner is removed.

Figures 6, 7, 8:
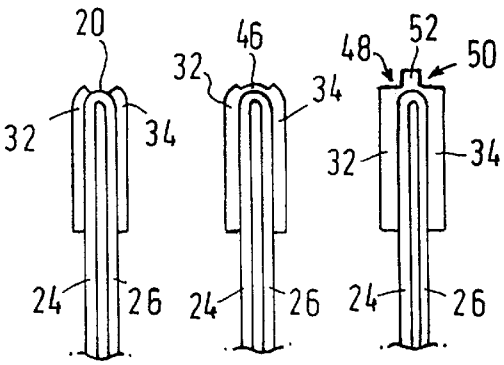
FIGS. 6 to 8 are schematical side views of dust bags according to the invention with different kinds of preferred mounting elements.

FIG. 6 shows an example where the two mounting elements 32,34 are completely separated from each other and only connected by the two wall portions 24,26 along the common edge 20 of the two wall portions 24,26. An alternative is shown in FIG. 7 wherein the two mounting elements 32,34 are integrally connected with each other via a flexible element such as a living hinge 46 or the like. The preferred alternative is shown in FIG. 8 where the collar 28 preferably consists of a plastic material which is provided with two cuts which only penetrate partially into the material so that essentially two hinges 48,50 are formed. Two hinges 48,50 are preferred to a single one as the width of the dust bag is better accommodated by the distance between the two adjacent hinges 48,50. Thus, a spacer element 52 arranged between the two mounting elements 32,34 has a width corresponding to the thickness of the wall portions 24,26 arranged between the mounting elements 32,34 in the overlaying state.

The intake opening receiving the socket piece can have any suitable form, e.g. the form of a cross. Other configurations can be contemplated, such as a rectangular opening, an elliptical one or anything else. It has to be ensured that in all cases it is possible to open the two elements 32,34 of the collar 28 after assembly so that they form an essentially flat configuration.

Figure 9:
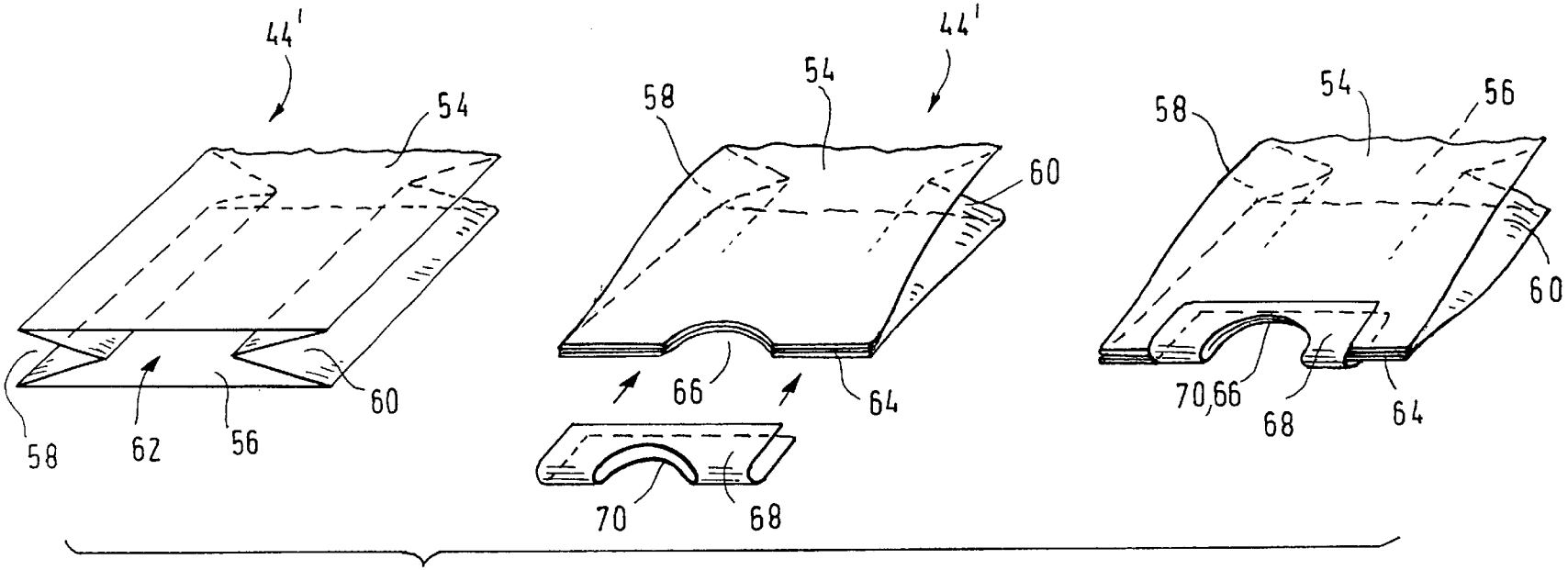
FIGS. 9 and 10 illustrate the manufacture of a three-dimensional dust bag according to another preferred embodiment of the invention.
Figure 10:
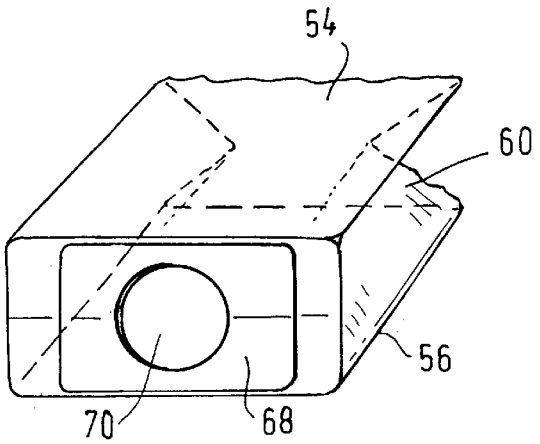

While the flat bags appear to be a particularly preferred configuration due to their simplicity and thus relatively low cost, also other configurations of so-called three-dimensional bags 44' as shown in FIGS. 9 and 10 are possible. The two wall portions 54,56 can be brought into a configuration so that opposing folds 58,60 inwardly directly are obtained. After cutting off the individual bag, the two ends 62 are sealed together in essentially the same manner as described above to form an outer edge 64 of the three-dimensional bag 44'. Recesses 66 are cut in both of the wall portions 54,56 with both recesses 66 being open to the outer edge 64 forming an intake opening 70. Thereafter, the collar 68 is attached to the wall portions 54,56 as explained above in connection with the other embodiments. As an alternative, first the collar 68 can be mounted to the wall portions 54,56 extending along the outer edge 64 so that upon forming recesses 66 in the wall portions 54,56, recesses are formed simultaneously also in the collar 68 to create the intake opening 70.

It should, however, be ensured that the internal folds 58,60 of the dust bag 44' do not get in touch with each other because it is necessary that in the area of the opening of the collar only one upper and one lower wall portion 54,56 is obtained because otherwise the desired opening cannot be easily generated or the unfolding of the bag would be inhibited (FIG. 10).

According to another embodiment which would allow one to produce a bag in a particularly simple manner, the two opposing wall portions are formed by a single sheet of material, which is folded onto itself with the folding line extending in the feeding direction and defining an outer edge of the dust bag. Then, the sheet is joined together only at the other outer edge. The bag may then be produced in the same manner as depicted in FIG. 1.

We claim:

1. A method for manufacturing dust bags, particularly for vacuum cleaners, comprising the steps of:

overlaying two wall portions of a filter material such that said wall portions are connected along an outer edge of the bag, and cutting recesses into both wall portions within one step which recesses are open to said outer edge and together form an intake opening.

2. The method for manufacturing dust bags according to claim 1 comprising the additional step after the cutting step surrounding the recesses of said wall portions with a mounting means at opposite sides of said wall portions facing away from each other.

3. The method according to claim 2, wherein the mounting means comprises two mounting elements each fixed to one wall portion adjacent to said outer edge and opposed to each other in the overlaying state of the wall portions.

4. The method for manufacturing dust bags particularly for vacuum cleaners, comprising the steps of:

overlaying two wall portions of a filter material such that said wall portions are connected along an outer edge of the bag;

fixing a mounting element to each of said wall portions at the outer sides such that the mounting elements are opposed to each other and arranged adjacent to said outer edge of said wall portions; and cutting recesses into both wall portions and both mounting elements within one step which recesses are open to said, outer edge and form an intake opening.

5. The method according to claim 4 wherein in the first step two sheets of filter material are fed separately and connected to each other to form said two opposing wall portions with said outer edge.

6. The method according to claim 4 wherein in the first step only one sheet is fed that is folded to form said two opposing wall portions with the folding line extending in the feeding direction.

7. The method according to claim 5 wherein at least one of said sheets is additionally folded to form a three-dimensional dust bag.

8. The method according to claim 1 wherein the wall portions are cut so as to form dust bags after cutting of the recesses, respectively.

9. The method according to claim 8 wherein said two opposing wall portions are connected to each other along two connecting lines respectively, which are perpendicular to the feeding direction and between which connecting lines the wall portions are cut so as to form dust bags.

10. The method according to claim 9 wherein said recesses are cut simultaneously into two adjacent dust bags prior to separating the wall portions into dust bags.

11. The method according to claims 8 wherein all unconnected outer edges of the dust bag are connected prior to separating the wall portions into dust bags.

12. The method according to claim 8 wherein the connection of the wall portions is performed by heat-sealing or ultrasonic welding or adhering through an adhesive.

* * * * *